United States Patent [19]

Glenny et al.

[11] 4,367,432

[45] Jan. 4, 1983

[54] BLENDED LAMP

[75] Inventors: Alfred E. T. Glenny; Johannes A. J. M. Van Vliet, both of Eindhoven, Netherlands

[73] Assignee: U.S. Philips Corporation, New York, N.Y.

[21] Appl. No.: 125,009

[22] Filed: Feb. 27, 1980

[30] Foreign Application Priority Data

Apr. 3, 1979 [NL] Netherlands ..... 7902573

[51] Int. Cl.[3] ..... H01J 7/44; H01J 17/34; H01J 19/78; H01J 29/96

[52] U.S. Cl. ..... 315/49; 313/225; 313/229; 315/179; 315/181

[58] Field of Search ..... 313/225, 229; 315/178, 315/179, 180, 181, 49

[56] References Cited

U.S. PATENT DOCUMENTS

| | | | |
|---|---|---|---|
| 2,208,998 | 7/1940 | Mey | 315/49 |
| 2,329,626 | 9/1943 | Krefft et al. | 315/49 |
| 3,048,741 | 8/1962 | Thouret | 315/49 |
| 3,384,798 | 5/1968 | Schmidt | 313/225 X |
| 3,445,719 | 5/1969 | Thouret et al. | 315/49 |
| 3,851,207 | 11/1974 | McVey | 315/49 |
| 4,146,813 | 3/1979 | Van Vliet | 313/225 |
| 4,253,037 | 2/1981 | Driessen et al. | 313/229 |

FOREIGN PATENT DOCUMENTS

| | | | |
|---|---|---|---|
| 1332852 | 10/1973 | United Kingdom | 315/49 |

*Primary Examiner*—Saxfield Chatmon, Jr.
*Attorney, Agent, or Firm*—Robert S. Smith

[57] ABSTRACT

In a blended lamp, an incandescent filament and a high-pressure discharge tube are arranged electrically in series. The filament forms part of a halogen incandescent lamp and the discharge tube contains a sodium amalgam which is very high in mercury. A relatively high lumen per Watt-value is thereby combined with an acceptable color of the light.

2 Claims, 1 Drawing Figure

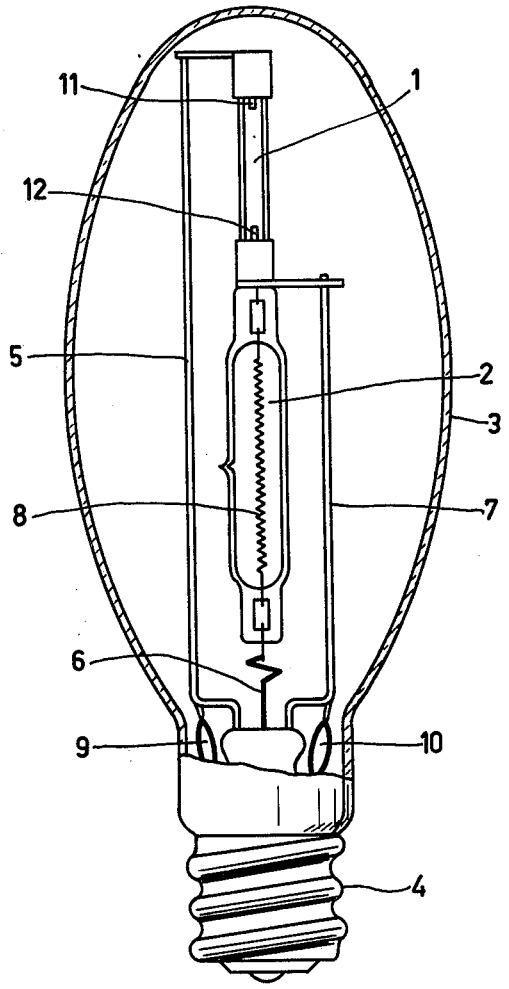
11
1
12
5
2
3
8
7
6
9
10
4

BLENDED LAMP

The invention relates to a blended lamp having an incandescent filament which is electrically arranged in series with a high-pressure sodium discharge tube, the discharge tube containing mercury and a starting gas in addition to sodium, the percentage by weight G of the mercury in the discharge tube exceeding 80% of the combined weight of the mercury and the sodium.

Such a blended lamp has the advantage that it can be connected—like an incandescent lamp—to an electric supply source without the need for an external ballast; the reason being that the filament in the blended lamp also operates as a stabilization ballast for the discharge tube.

A known blended light lamp of the above-mentioned type is, for example, disclosed in the Japanese Patent Application No. PA-46-32858 (publication number Sho-45083), which was laid open to public inspection on Dec. 23, 1972. This known lamp has the drawback that the amalgam in the discharge tube has such a composition that G is not more than approximately 83%. This means that the weight ratio between the mercury and the sodium in the discharge tube is not more than approximately 5. Consequently, with that known lamp, when fed from an a.c. voltage source, the required re-ignition voltage of the discharge tube—at the beginning of each half cycle of the electric supply—is relatively high. This has the result that the arc voltage of the discharge tube can only be relatively low with respect to the voltage of the a.c. voltage source. Accordingly the result thereof being that the luminous efficacy, for example expressed in lumens per Watt, of the known blended lamp is relatively low.

It should be noted that the luminous efficacy of a discharge lamp, and, consequently, also of a blended lamp, depends as a rule also on the lamp power. In general, the luminous efficacy increases when the lamp power increases.

The invention has for its object to provide a blended lamp of the type defined in the opening paragraph wherein the luminous efficacy is high—having regard to the lamp power—and the color of the emitted light is acceptable.

A blended lamp according to the invention having an incandescent filament which is electrically arranged in series with a high-pressure sodium vapor discharge tube, the discharge tube containing mercury and a starting gas in addition to sodium, and the percentage by weight G of the mercury in the discharge tube exceeding 80% with respect to the combined weight of the mercury and the sodium, is characterized in that the filament forms part of a halogen incandescent lamp and that G is between 85% and 98%.

An advantage of this blended lamp is that its luminous efficacy is high and the color of the emitted light is acceptable.

The underlying notion of the invention is to reduce the required re-ignition voltage of the discharge tube of a blended lamp by using an amalgam which is very rich in mercury, that is to say by using a high G-percentage. This indeed causes the color of the light emitted by the discharge tube to be less white and, consequently, less acceptable, but this is compensated by constructing the incandescent portion of that blended lamp as a halogen incandescent lamp. In addition, by choosing a halogen incandescent lamp instead of a common incandescent lamp, the luminous efficacy of the blended lamp according to the invention is still further increased.

With G-values which are below 85% or above 98%, the luminous efficacy of the blended lamp is relatively low. With G-values above 98% a further drawback may be that a considerable change in color becomes manifest after a small number of operating hours of the lamp, due to the disappearance of the sodium, which is then present in very small quantities, even in the discharge tube of a new lamp.

It should be noted that using a halogen incandescent lamp in series with a discharge tube is known per se from German "Offenlegungsschrift" No. 2,205,680. However, the halogen incandescent lamp is there only an auxiliary lamp which emits light only during starting of the discharge tube.

In a preferred embodiment of a blended lamp according to the invention, G is 95%±0.5%. This has the advantage that the luminous efficacy of the blended lamp has a very high value.

An embodiment according to the invention will now be further explained with reference to the accompanying drawing, which shows a partly longitudinal section, partly elevational view of a low-power blended lamp according to the invention.

The drawing shows a blended lamp having an overall length of approximately 165 mm and a maximum width of approximately 65 mm. Reference numeral 1 denotes a high-pressure sodium vapor discharge tube. This discharge tube 1 is electrically arranged in series with a halogen incandescent lamp 2. The assembly of discharge tube 1 and halogen incandescent lamp 2 is enveloped by an outer bulb 3. A base of the lamp is denoted by reference numeral 4. One end of the series arrangement of the discharge tube 1 and the halogen incandescent lamp 2 is electrically fed via the pole wire 5 and the other end via the current conductor 6. The pole wire 5 and the current conductor 6 are connected to contacts of the lamp base 4 (connections are not shown). A rigid metal wire 7 of nickel-coated iron has for its sole function to provide an additional support of the discharge tube 1 and halogen incandescent lamp 2 assembly.

The discharge tube 1 has a wall which predominantly consists of densely sintered aluminium oxide. The discharge tube is approximately 40 mm long and its inside diameter is approximately 3.3 mm. Main electrodes 11 and 12, are disposed at each end of the discharge tube. That tube 1 further comprises a mercury-sodium amalgam having a weight of 10 milligram. The percentage by weight G of mercury of that amalgam is 95%. G is therefore located within the specified range of 85%-98%, and also within the preferred range of 95%±0.5%. In addition, the discharge tube comprises a starting gas consisting of neon with 0.3% of argon under a pressure of approximately 5000 Pascal, to promote the ignition of the discharge in the discharge tube.

The halogen incandescent lamp 2 comprises a tungsten filament 8. The incandescent lamp 2 is approximately 60 mm long. Reference numerals 9 and 10 are getter rings to maintain the vacuum between the discharge tube 1 and the incandescent lamp 2 on the one hand and the outer bulb 3 on the other hand.

The described blended lamp is intended to be connected by means of the lamp base 4 to a.c. line voltage of approximately 220 Volt, 50 Hz. The blended lamp then consumes approximately 103 Watt, 41 Watt thereof being consumed by the discharge tube 1. The arc voltage of the discharge tube is then approximately 110 Volts and its required re-ignition voltage is approximately 270 Volts. The luminous efficacy of the discharge tube alone is then approximately 54 lumen per Watt. The luminous flux of the overall blended lamp is approximately 3150 lumen and the luminous efficacy approximately 30.5 lumen per Watt. The C.I.E. (Commission Internationale de l'eclairage)-colour rendering index Ra8 is approximately 70.

The described blended lamp of a relatively low power—namely approximately 100 Watt—combines a relatively high luminous efficacy with an acceptable color rendering.

What is claimed is:

1. A blended lamp having an incandescent filament in a halogen atmosphere which is electrically arranged in series with a high-pressure sodium vapor discharge tube, the discharge tube containing mercury and a starting gas in addition to sodium, the percentage by weight "G" of the mercury in the discharge tube being between 91 and 98% of the combined weight of the mercury and the sodium in the discharge tube.

2. A blended lamp as claimed in claim 1, characterized in that G is 95%±0.5%.

* * * * *